US006142787A

United States Patent [19]

Ikesugi

[11] Patent Number: 6,142,787

[45] Date of Patent: Nov. 7, 2000

[54] ELECTRICAL CONNECTOR ASSEMBLY WITH MATING ASSIST LEVER

[75] Inventor: Hiroshi Ikesugi, Yokohama, Japan

[73] Assignee: Molex Incorporated, Lisle, Ill.

[21] Appl. No.: 09/322,610

[22] Filed: May 28, 1999

[30] Foreign Application Priority Data

May 29, 1998 [JP] Japan ..... 10-166391

[51] Int. Cl.[7] ..... H01R 13/62

[52] U.S. Cl. ..... 439/15; 439/372; 439/370; 439/352

[58] Field of Search ..... 439/157, 153, 439/372, 160, 152, 357, 358, 370, 352

[56] References Cited

U.S. PATENT DOCUMENTS

| | | | |
|---|---|---|---|
| 4,303,292 | 12/1981 | McNeel | 339/45 |
| 4,911,647 | 3/1990 | Ferchau et al. | 439/157 |
| 5,022,866 | 6/1991 | Harting et al. | 439/372 |
| 5,035,634 | 7/1991 | Hasircoglu et al. | 439/157 |
| 5,308,254 | 5/1994 | Hatagishi et al. | 439/157 |
| 5,385,870 | 1/1995 | Maue et al. | 439/157 |

FOREIGN PATENT DOCUMENTS

| | | | |
|---|---|---|---|
| 87104821 | 1/1988 | European Pat. Off. . | |
| 3007978 | 9/1981 | Germany | 439/372 |
| 3611661 C1 | 11/1987 | Germany . | |
| 0658628 | 10/1951 | United Kingdom | 439/372 |

*Primary Examiner*—Paula Bradley
*Assistant Examiner*—Tho D. Ta

[57] ABSTRACT

An electrical connector assembly includes a connector having a housing adapted for mating with an appropriate complementary mating connector. A pivot post is fixed to and projects from the housing. A lever is pivotable about the pivot post between operative and inoperative positions for mating and unmating the connectors. The lever includes an aperture embracing the pivot post. The aperture is larger than the post to allow for lost motion between the lever and the post. The lever includes a latch portion engageable with the mating connector for drawing the connectors into mated condition in response to rotating the lever about the pivot post from the inoperative position to the operative position. A spring is operatively associated between the lever and the pivot post to bias the lever in the mating direction of the mating connector when the lever is in its operative position to, thereby, bias the mating connector into a fully mated position.

15 Claims, 9 Drawing Sheets

ELECTRICAL CONNECTOR ASSEMBLY WITH MATING ASSIST LEVER

FIELD OF THE INVENTION

This invention generally relates to the art of electrical connectors and, particularly, to an electrical connector assembly wherein a lever is used to assist in mating a pair of connectors.

BACKGROUND OF THE INVENTION

There are various applications in which a large number of electrical wires must be terminated in a single electrical connector which, in turn, is mated with a complementary connector that also is terminated to the same large number of electrical wires. One such example of this type of application is in machine tools and robotic applications, such as in the automotive industry. In a typical example, six electrical wires may be required for each axis of a hexaxial robot, resulting in a total of thirty-six wires having to be terminated to thirty-six terminals mounted on an insulative housing. These wires must be connected individually, and care must be taken that they are connected in their designated groups of six wires.

It can be understood from the above that problems often can be encountered in terminating such electrical connectors having such large numbers of wires and terminals. The connecting process may be difficult and inefficient. This is particularly true if the lengths of the respective wires, such as in a wiring harness, are different due to the difference in positions of the axes of a robot, for instance. Other problems are encountered in the inefficiency of using such wiring systems when maintenance or replacement must be performed. Other problems encountered with such connectors include the difficulty in polarizing such large connectors, in grounding such connectors and in ensuring that the connectors are fully mated. Often, lever-type assisting mechanisms are used to ensure that the connectors in a connector assembly are fully mated.

The present invention is directed to solving one or more of the problems discussed above.

SUMMARY OF THE INVENTION

An object, therefore, of the invention is to provide an electrical connector assembly with a new and improved mating assist lever system.

In the exemplary embodiment of the invention, the assembly includes a connector having a housing adapted for mating with an appropriate complementary mating connector. A lever pivot post is fixed to and projects from the housing. A lever is pivotable about the pivot post between operative and inoperative positions for mating and unmating the connectors. The lever includes an aperture embracing the pivot post. The aperture is larger than the post to allow for lost motion between the lever and the post. The lever includes a latch portion engageable with the mating connector for drawing the connectors into mated condition in response to rotating the lever about the pivot post from its inoperative position to its operative position. A spring is operatively associated between the lever and the pivot post to bias the lever in the mating direction of the mating connector when the lever is in its operative position. Therefore, the spring also biases the mating connector into a fully mated position.

As disclosed herein, the spring is generally U-shaped with a distal end of one leg fixed to the lever and a distal end of an opposite leg fixed to the pivot post. The housing includes a cover having the pivot post thereon and on which the lever is mounted. The lever is generally U-shaped and straddles the housing or cover, with a pair of lever arms on opposite sides of the cover pivotable about a pair of pivot posts at opposite sides of the cover. At least one of the springs is operatively associated between each one of the lever arms and one of the pivot posts.

The latch portion of the lever is located at one side of the pivot post, and the spring is located at an opposite side of the pivot post. The latch portion of the lever is formed as a latch hook for engaging a latch projection on the mating connector. A feature of the invention is directed to the provision of an enlarged detent recess at a base of the latch hook and into which the latch projection of the mating connector "snaps". This gives an audible and tactile indication of the fully mated position of the mating connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
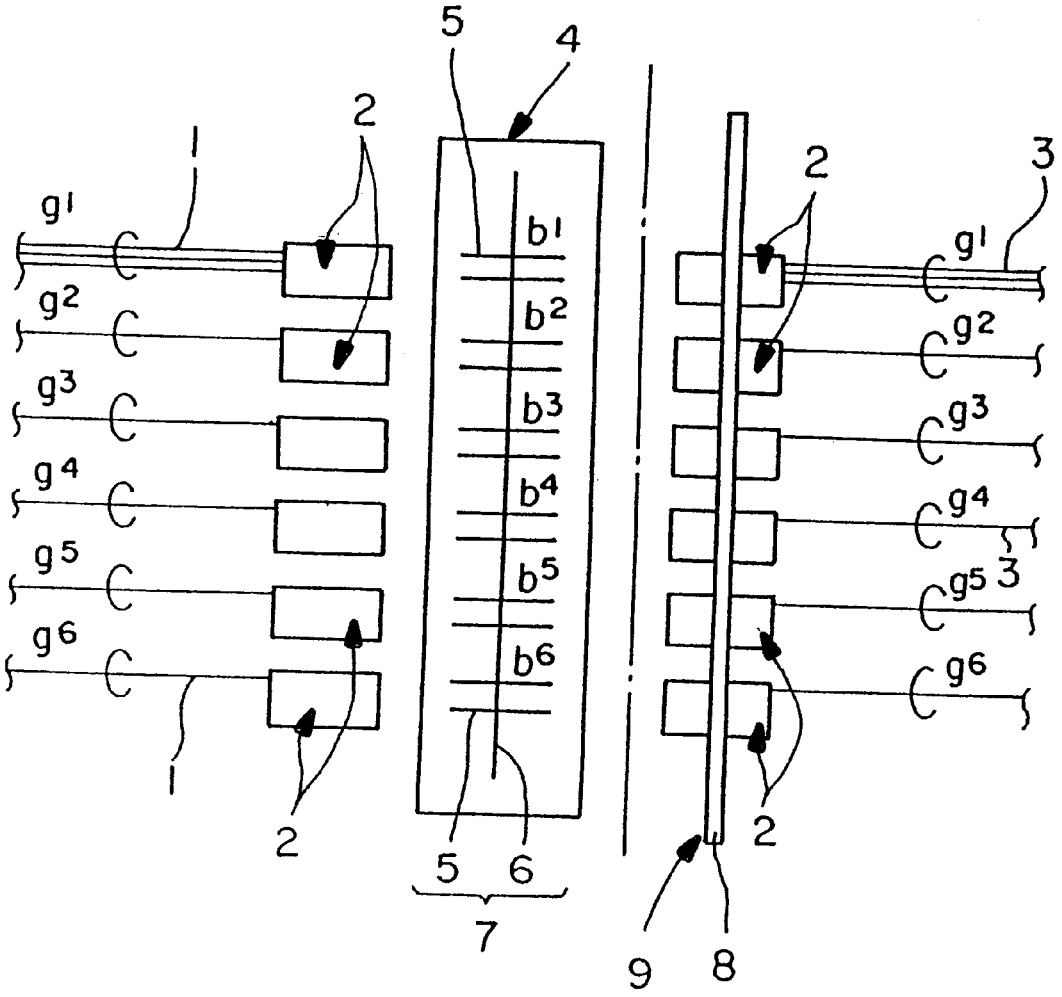
FIG. 1 is a somewhat schematic or block diagram of a termination system provided by the connector assembly of the invention.
Figure 16:
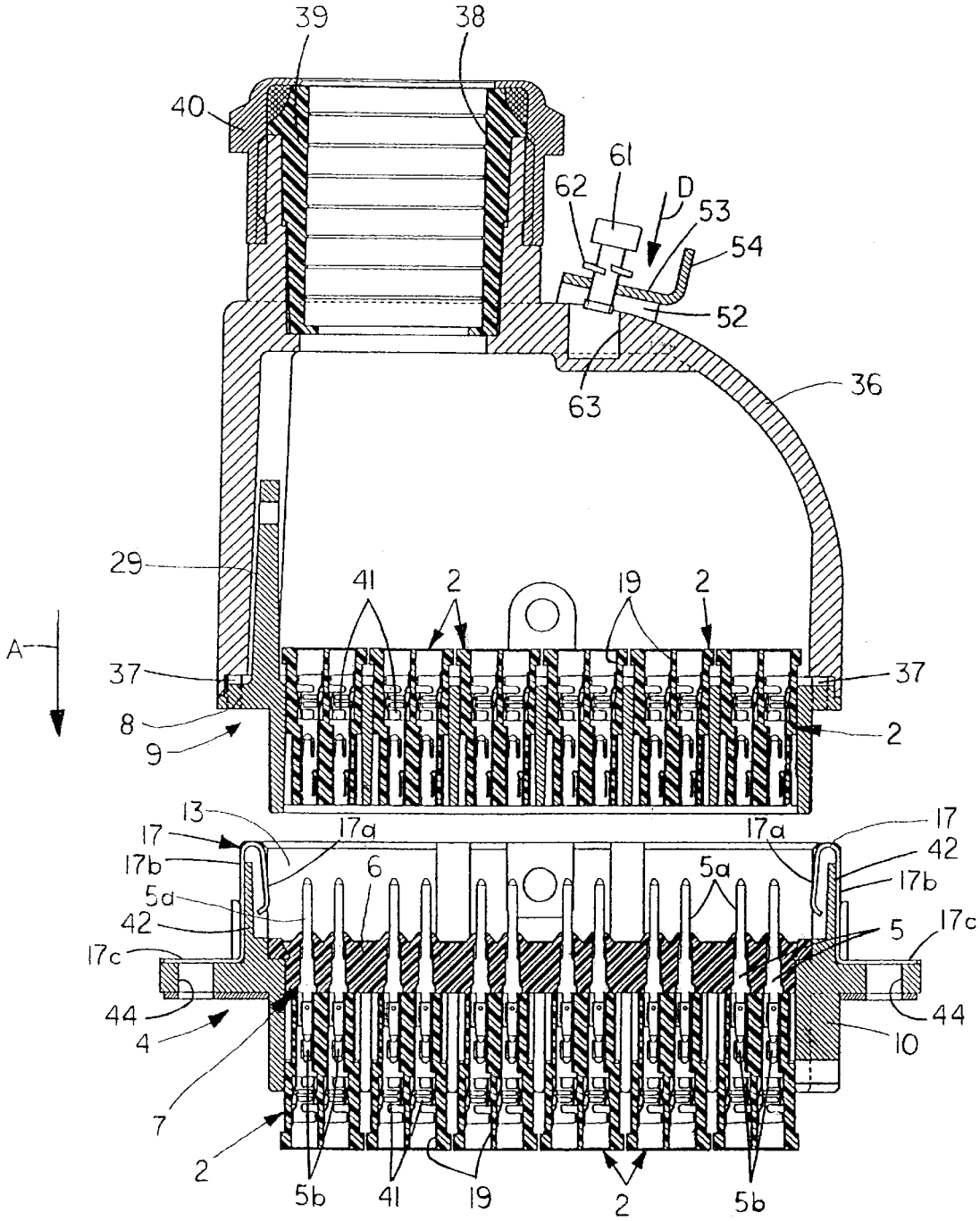
FIG. 16 is a section through the entire electrical connector assembly incorporating the concepts of the invention, taken in the mating direction of the connectors and with the connectors in unmated condition.
Figure 17:
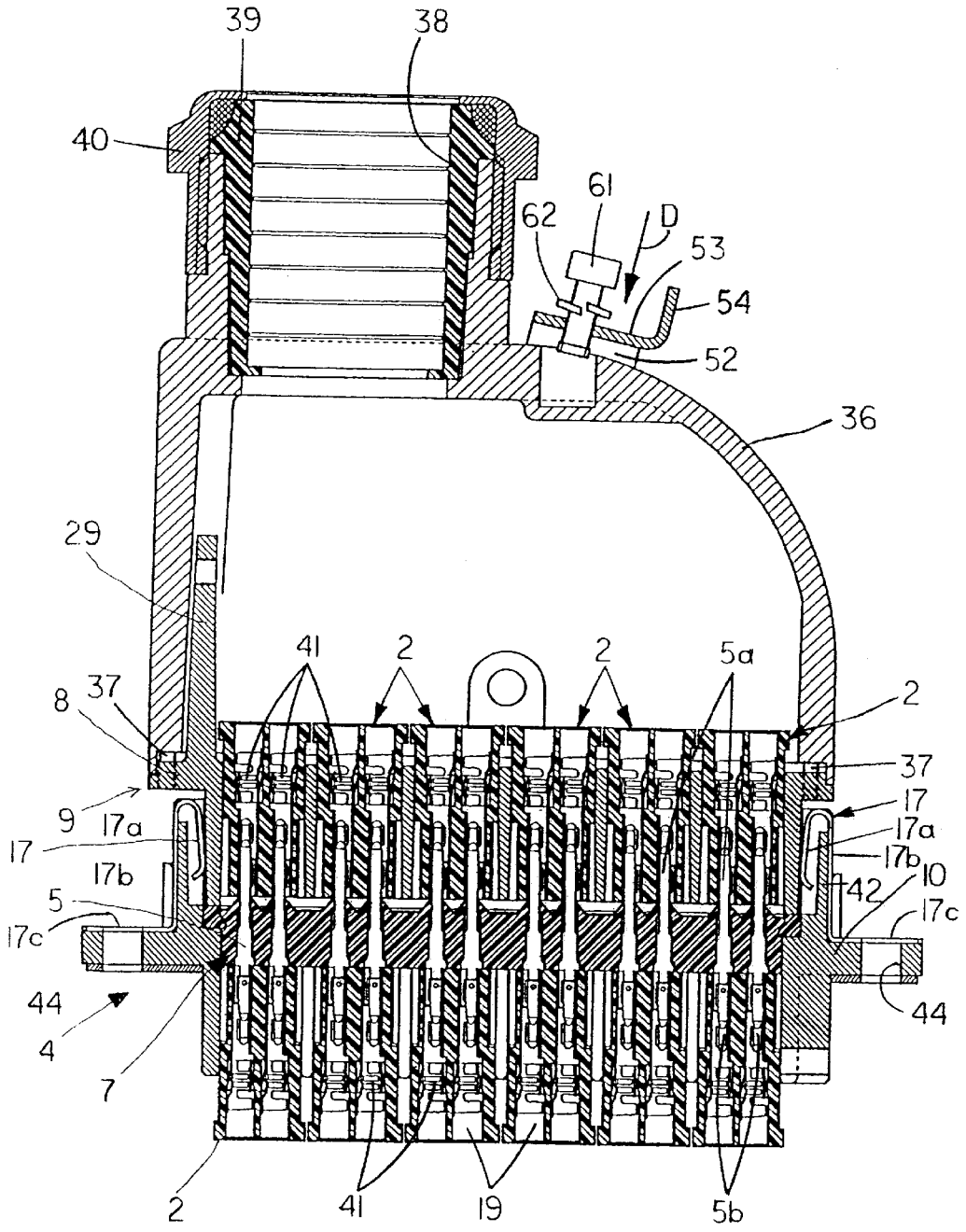
FIG. 17 is a sectional view similar to that of FIG. 16, but with the connectors in mated condition.
Figure 18:
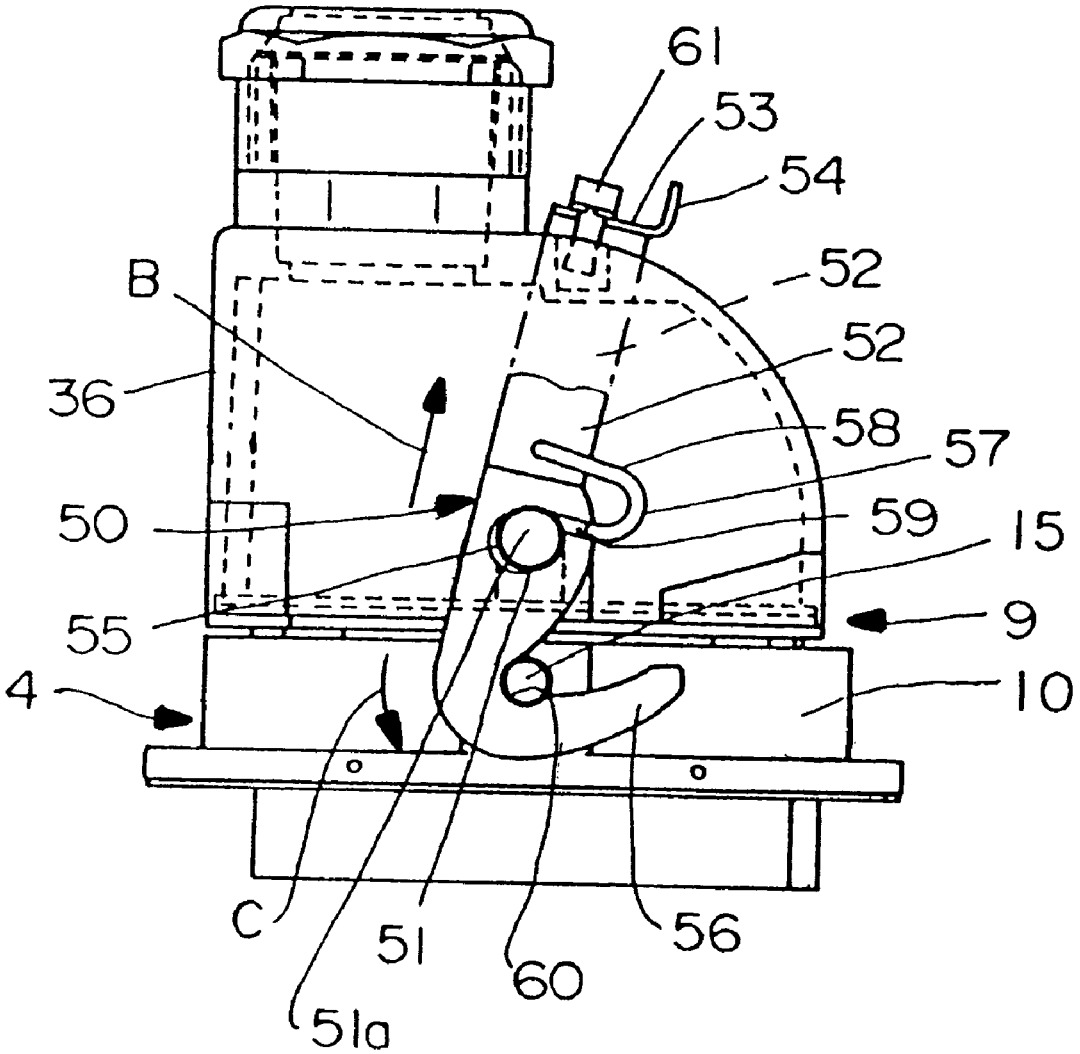
FIG. 18 is a side elevational view of the mated connector assembly as shown in FIG. 17.

Referring to the drawings in greater detail, FIG. 1 shows a somewhat schematic or block diagram of the termination system afforded by the connector assembly of the invention. FIGS. 2–6 show the receptacle connector of the connector assembly. FIGS. 7–10 show one of the identical connector modules that are used in both the plug connector and the receptacle connector of the assembly. FIGS. 11–15 show the plug shell of the plug connector. FIGS. 16–18 show the entire connector assembly including both the receptacle connector and the plug connector.

Turning to first to FIG. 1, the connector assembly of the invention is readily applicable for use in such applications as robotic applications involving machine tools, assembly apparatus and the like, which may be encountered in the automotive industry, for instance. With that understanding, the left-hand side of FIG. 1 might represent a controlled side of a machine tool such as a robot main body, and the right-hand side of FIG. 1 might represent a control equipment side such as a controller. The controlled side at the left of FIG. 1 includes a plurality of wires 1 divided into six groups "g1–g6". The six groups of wires 1 are terminated to six identical connector modules, generally designated 2. The right or control equipment side of FIG. 1 shows a plurality of wires 3 in six groups "g1–g6", with the wires in each group terminated to identical connector modules, generally designated 2. All of connector modules 2 on both the left and right sides of the termination system can be identical in structure and configuration.

Still referring to FIG. 1, a first or receptacle connector, generally designated 4, includes a plurality of terminal pins 5 mounted through an insulative or dielectric wafer 6 to form a wafer assembly 7 within receptacle connector 4. The pins are arranged in six clusters "b1–b6". The six connector modules 2 terminated to the six groups of wires 3 on the control equipment side are mounted in a plug shell 8 of a second or plug connector, generally designated 9. With the termination system of FIG. 1, group "g1" of wires 1 terminated to connector module 2 on the left or controlled side of the system are connected through terminal pins "b1" of receptacle connector 4 to wires 3 in group "g1" terminated in one of the connector modules 2 of plug connector 9, and so on through groups "g2–g6" of wires in the system.

Figure 5:
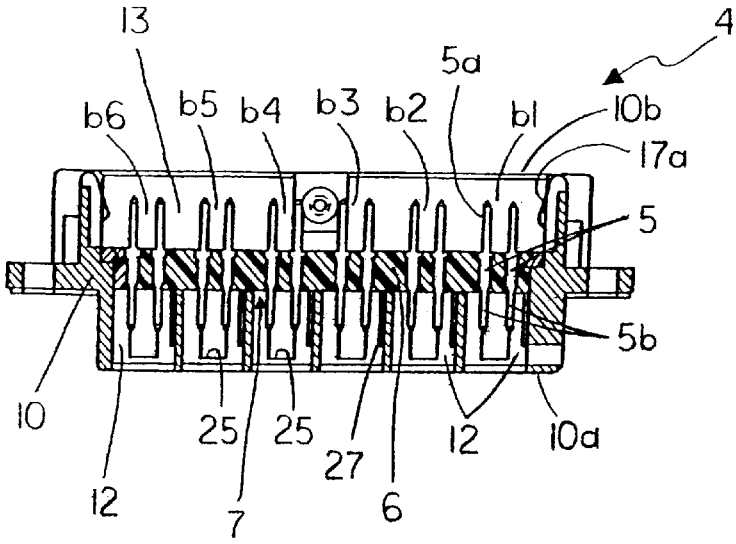
FIG. 5 is a section taken generally along line A—A of FIG. 2.
Figure 6:
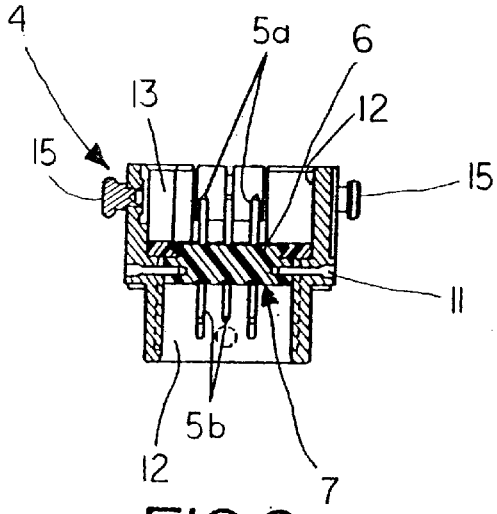
FIG. 6 is a section taken generally along line B—B of FIG. 2.
Figure 7:
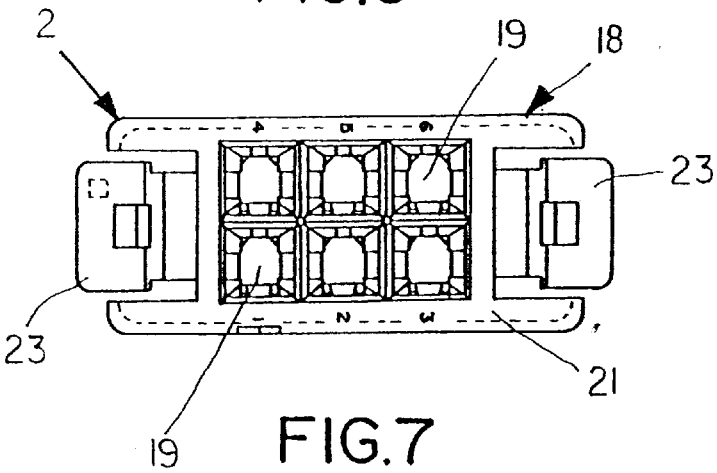
FIG. 7 is a plan view looking at the termination face of one of the connector modules, on an enlarged scale.
Figure 8:
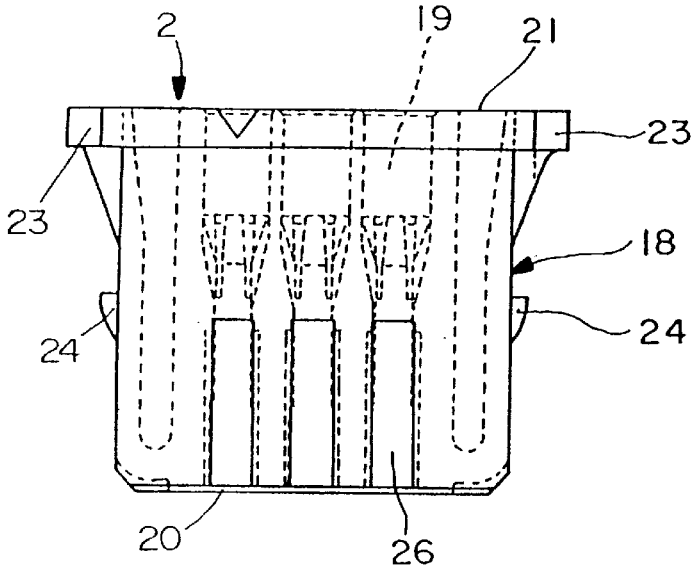
FIG. 8 is a side elevational view of the connector module of FIG. 7.
Figure 9:
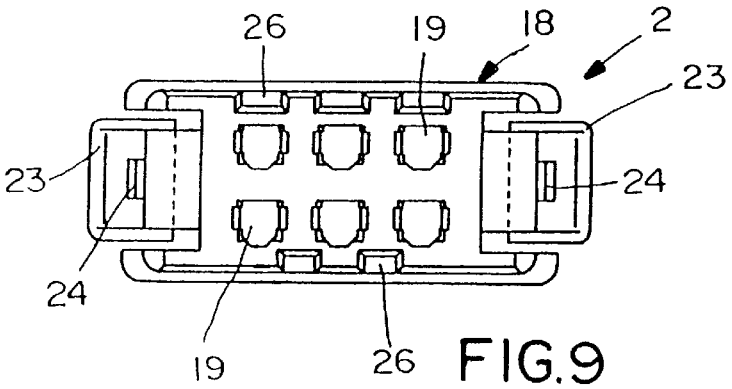
FIG. 9 is a plan view of the mating face of the connector module.
Figure 10:
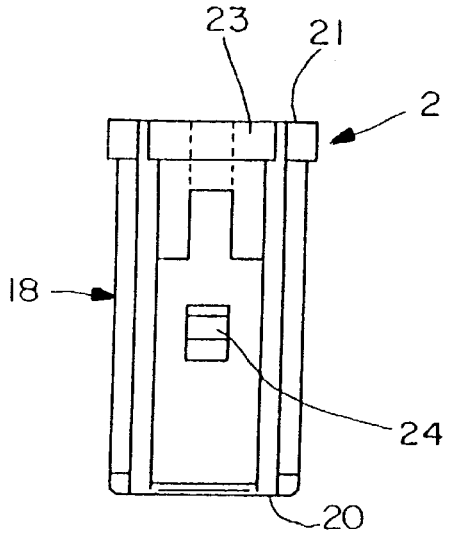
FIG. 10 is an end elevational view of the connector module.

FIGS. 2–6 show plug connector 4 (FIG. 1) with dielectric wafer 6 and terminal pins 5 mounted within a generally rectangular outer housing 10. The housing is fabricated of die cast metal material, such as aluminum. Wafer assembly 7, including wafer 6 and terminal pins 5, is secured within the housing by locking pins 11 (FIG. 6). The terminal pins are arranged in six clusters of six pins corresponding to clusters "b1–b6" as described above in relation to FIG. 1.

Still referring to FIGS. 2–6, housing 10 of receptacle connector 4 defines a terminal face 10*a* and a mating face 10*b*. Six identical module-receiving receptacles 12 (FIG. 5) are formed in termination face 10*a* for receiving six connector modules 2 (FIG. 1). A generally rectangular plug-receiving receptacle 13 is formed in mating face 10*b* for receiving a plug portion of plug shell 8 (FIG. 1) of plug connector 9, as described hereinafter. Terminal pins 5 are mounted through wafer 6 as best seen in FIGS. 5 and 6 and include mating ends 5*a* projecting into plug-receiving receptacle 13 and connector ends 5*b* projecting into module-receiving receptacles 12.

Finally, a latch post 15 projects outwardly from each opposite side of housing 10 of receptacle connector 4 for purposes described hereinafter. A polarizing recess 16 is formed in three corners of receptacle 13. The recesses are in the form of grooves extending in the mating direction of the connectors. A grounding clip 17 (FIG. 2) is mounted at each opposite end of housing 10 of receptacle connector 4 as will be described in greater detail hereinafter.

FIGS. 7–10 show one of the connector modules 2 (FIG. 1) which are inserted into receptacles 12 (FIG. 5) of receptacle connector 4. The connector modules also are mounted in plug shell 8 (FIG. 1) of plug connector 9 as described hereinafter. It should be understood that the terminals have been removed from module 2 in FIGS. 7–10 to avoid cluttering the illustration.

Figure 2:
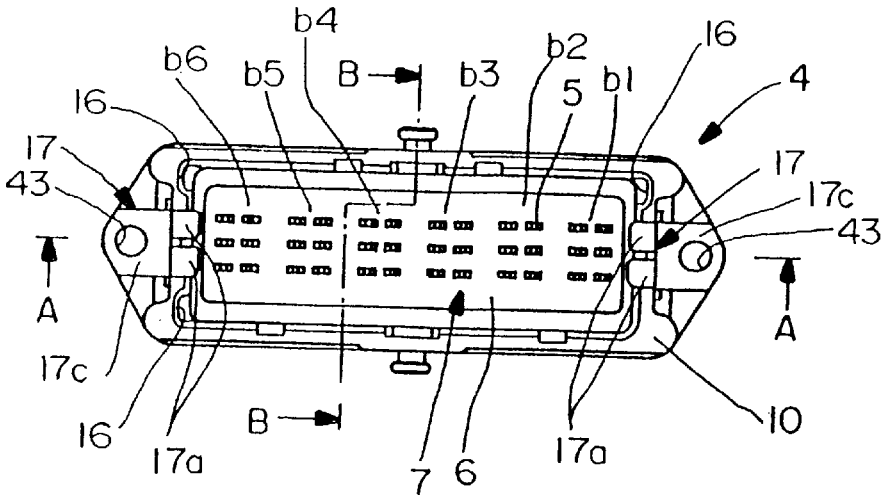
FIG. 2 is a plan view of the receptacle or mating end of the plug connector of the connector assembly.
Figure 3:
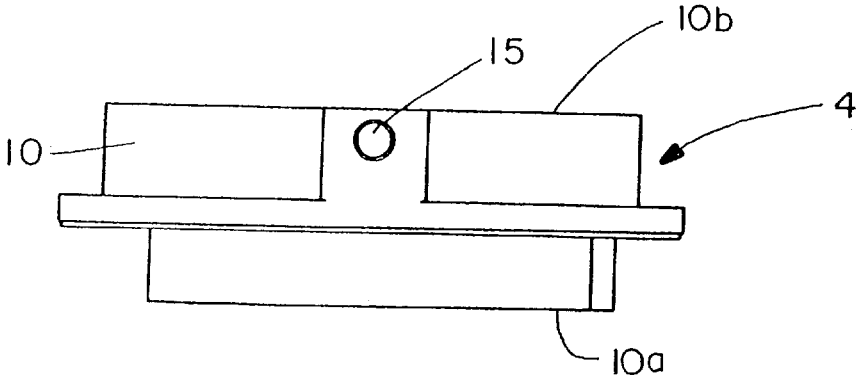
FIG. 3 is a side elevational view of the plug connector.
Figure 4:
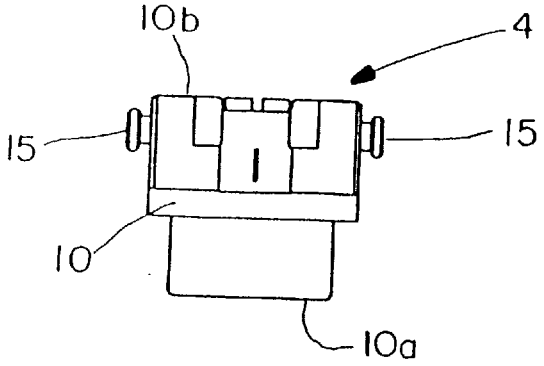
FIG. 4 is an end elevational view of the plug connector.

More particularly, each module 2 (FIGS. 7–10) includes an insulative or dielectric housing, generally designated 18. The housing includes a plurality of terminal-receiving passages 19. Six passages are provided corresponding to the six terminal pins in each of the clusters of pins "b1–b6" (FIGS. 1 and 2). Housing 18 defines a connecting or mating end 20 and a termination end 21. The mating end is inserted into one of the module-receiving receptacles 12 (FIG. 5) of receptacle connector 4, and electrical wires 1 (FIG. 1) are terminated to female terminals inserted into passages 19 through termination end 21. A pair of cantilevered latch arms 23 are provided at opposite ends of housing 18. The latch arms have chamfered latch projections 24 which latch behind latch shoulders 25 (FIG. 5) within receptacles 12 of receptacle connector 4. Key grooves 26 are formed in opposite sides of housing 18 for receiving keying ribs 27 (FIG. 5) within receptacles 12 of receptacle connector 4 to polarize the modules and the receptacles so that the modules can be inserted into the receptacles in only given preselected orientations.

Referring to FIGS. 11–15, plug shell 8 of plug connector 9 (FIG. 1) is shown in detail. The plug shell is formed of die cast metal, such as aluminum, similar to housing 10 of receptacle connector 4. The plug shell includes a generally rectangular body 8*a* having a peripheral flange 28 thereabout, along with a grounding pole 29 projecting from the flange opposite body 8*a*. The body has a plurality of partitions 30 which form a plurality of module-receiving receptacles 31. Receptacles 31 are similar to receptacles 12 (FIG. 5) of receptacle connector 4 for receiving identical connector modules 2. Similarly, polarizing keys 32 are provided within receptacles 31 for positioning in key grooves 26 of the connector modules. Latch shoulders 33 (FIG. 15) are provided for engaging latch projections 24 of cantilevered latch arms 23 of the connector modules.

Figure 11:
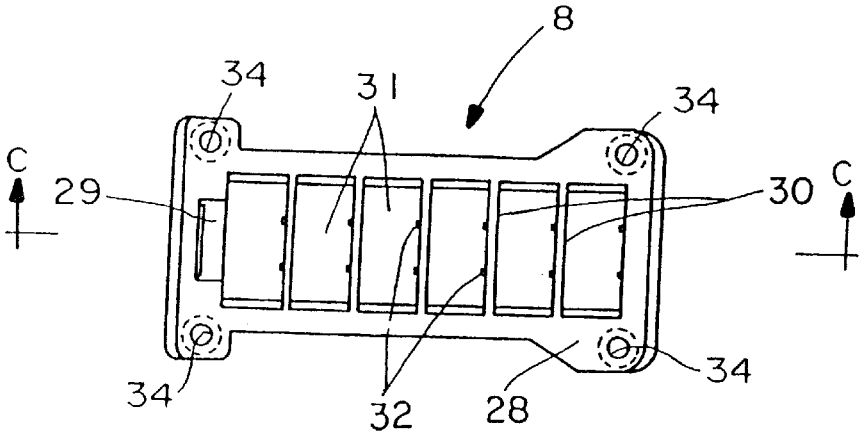
FIG. 11 is a plan view of the termination face of the plug shell of the plug connector of the connector assembly.
Figure 12:
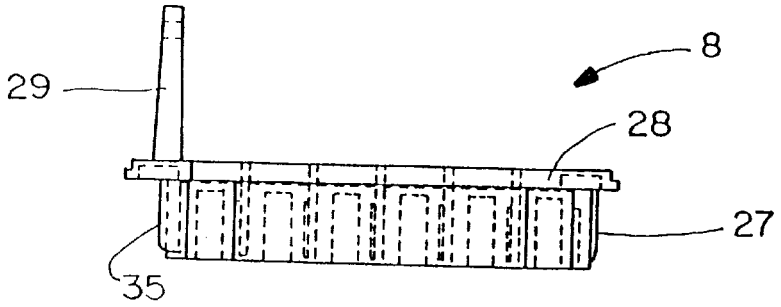
FIG. 12 is a side elevational view of the plug shell of FIG. 11.
Figure 13:
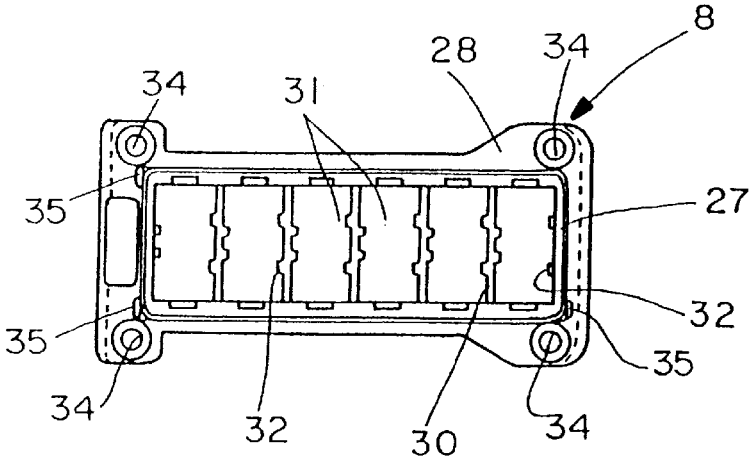
FIG. 13 is a plan view of the mating face of the plug shell.
Figure 14:
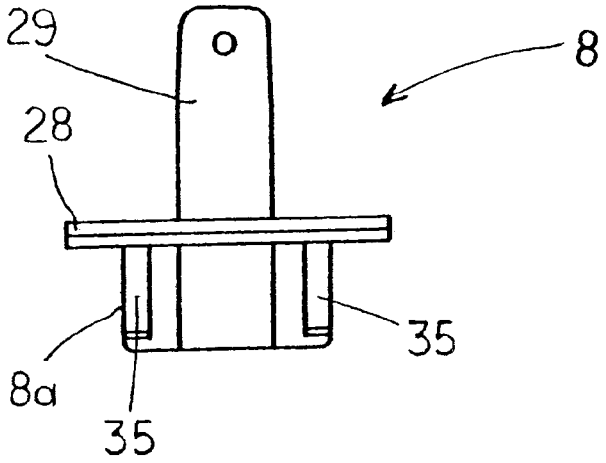
FIG. 14 is an end elevational view of the plug shell.
Figure 15:
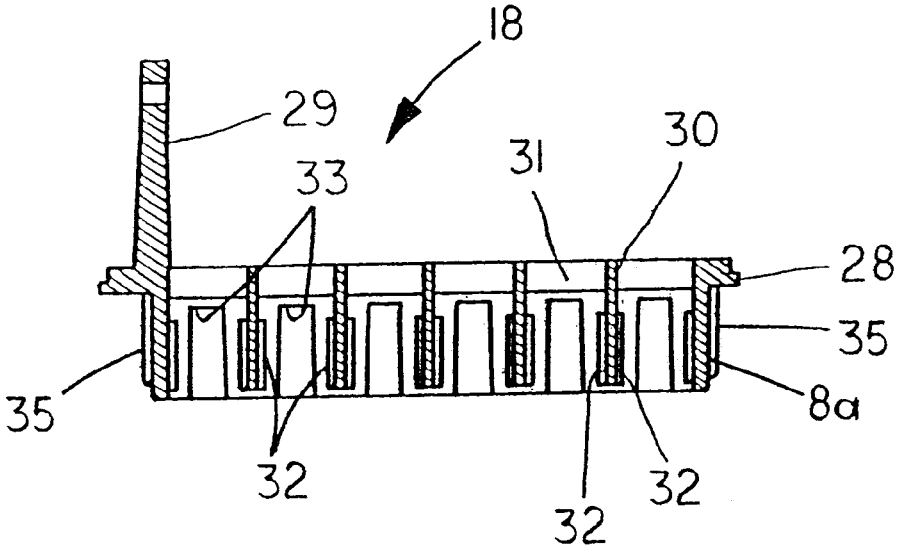
FIG. 15 is a section taken generally along line C—C in FIG. 11.

As best seen in FIGS. 11 and 13, mounting holes 34 are formed through flange 28 at the four corners thereof, for purposes described hereinafter. Finally, as best seen in FIG. 13, three polarizing ribs 35 are provided at three corners of rectangular body 8*a*. The polarizing ribs extend in the mating direction of plug connector 9 and are sized for insertion into polarizing grooves 16 (FIG. 2) of receptacle connector 4 to ensure that the plug connector can be inserted into the receptacle connector in only one given orientation.

Referring to FIG. 16 in conjunction with FIGS. 11–15, the housing of plug connector 9 is a two-part housing including plug shell 8 and a cover 36. Plug shell 8 is mounted within the bottom of cover 36 by means of fasteners 37 extending through mounting holes 34 (FIGS. 11 and 13) of the plug shell and into a lower peripheral edge of the cover. A wiring harness (not shown) extends through an entrance 38 to the inside of cover 36. A sealing gasket 39 may be compressed by a nut 40 about the wiring harness. The wiring harness will include electrical wires 3 (FIG. 1) for terminating to a plurality of female terminals 41 mounted within passages 19 of connector modules 2 mounted within plug shell 8.

FIG. 16 also shows identical female terminals 41 mounted within passages 19 of a plurality of connector modules 2 mounted within housing 10 of receptacle connector 4. It can be seen in FIG. 16 that connector ends 5*b* of terminal pins 5 are engaged by female terminals 41 mounted within housing 10 of receptacle connector 4. Mating ends 5*a* of terminal pins 5 which extend through wafer 6 of the receptacle connector, are aligned with female terminals 41 of connector modules 2 mounted within plug shell 8 of plug connector 4.

FIG. 17 shows plug connector 9 inserted into receptacle 13 of receptacle connector 4 in the direction of arrow "A". When fully mated, mating ends 5*a* of terminal pins 5 move into female terminals 41 mounted within connector modules 2 which, in turn, are mounted within plug shell 8 of plug connector 9.

FIGS. 16 and 17 also show the details of grounding clips 17. Specifically, each grounding clip is generally U-shaped to embrace a wall 42 of housing 10 of receptacle connector 4. Each U-shaped grounding clip is stamped and formed of conductive sheet metal material and has a first leg 17*a* disposed within receptacle 13 (FIG. 16) of the receptacle connector. A second leg 17*b* of the clip is positioned along the outside of wall 42 and terminates in an outwardly projecting flange 17*c*. The flange includes a mounting hole 43 (FIG. 2) aligned with a mounting hole 44 (FIGS. 16 and 17). Conductive fasteners are inserted through mounting holes 44 to mount the receptacle connector to a conductive chassis. Because of the tolerances involved in die casting housing 10 of receptacle connector 4 and plug shell 8 of plug connector 9, grounding clips 17 may be fabricated of material such as stainless steel to provide good positive engagement between the two connectors for grounding purposes. In fact, it can be seen in comparing FIG. 16 with FIG. 17 that legs 17*a* of the grounding clips within receptacle 13 of the receptacle connector form spring fingers for engaging the outside of plug shell 8. Grounding pole 29 of the plug shell also might be used for attachment to a ground wire from the wiring harness extending through entrance 38 of cover 36.

Referring to FIG. 18 in conjunction with FIGS. 16 and 17, a mating assist system is provided to ensure that receptacle connector 4 and plug receptacle 9 are fully mated. More particularly, a generally U-shaped lever, generally designated 50 (FIG. 18) is mounted for pivoting about a pivot post 51 which is fixed to and projects outwardly from each opposite side of cover 36. The U-shaped lever defines a lever arm 52 on each opposite side of the cover 36, joined by a bight portion 53. The bight portion has a flange 54 which defines a tab for facilitating manual grasping and manipulation of the lever. Each lever arm 52 has an aperture 55 which embraces a respective one of the pivot posts 51, and the aperture is larger than the pivot post to allow for lost motion between the lever and the posts. Each pivot post 51 includes a head portion 51*a* which is larger in diameter than aperture 55 so that the lever arms are maintained on the posts.

Each lever arm 52 of lever 50 includes a latch portion in the form of a hook 56 for engaging one of the latch posts 15 of receptacle connector 4. A generally U-shaped spring 57 defines a pair of legs 58 and 59. The distal end of leg 58 of the spring is anchored in lever arm 52. The distal end of leg 57 of the spring is wrapped around pivot post 51. With lost motion being provided between the lever and the pivot posts because of enlarged apertures 55, springs 51 are effective to bias the lever in the direction of arrow "B" which is generally in the mating direction of the connectors. Therefore, when lever 50 is pivoted about pivot posts 51 in the direction of arrow "C", latch hook 56 draws receptacle connector 4 into mating engagement with plug connector 9 through the interengagement of the latch hook with latch posts 15 of the receptacle connector. Springs 50 are effective to further draw lever 50 upwardly in the direction of arrow "B" which, in turn, draws receptacle connector 4 therewith to ensure that the connectors are fully mated.

An additional feature of mating assist lever 50 is that an enlarged detent recess 60 is formed at the base of each lever arm 52 and latch hook 56. These detent recesses allow latch posts 15 of receptacle connector 4 to "snap" into the recesses and render an audible and tactile indication that the connectors are fully mated.

Finally, a lock pin 61 (FIGS. 16–18) extends through bight portion 53 of lever 50. The lock pin is spring loaded by a spring 62 for biasing inwardly in the direction of arrow "D". When lever 50 is rotated to its complete mating position, lock pin 61 is biased by spring 62 into a locking hole 63 at the top of cover 36 to hold the lever in its full mating position.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector assembly, comprising:

a connector having a housing adapted for mating with an appropriate complementary mating connector, and a pivot post fixed to and projecting from the housing;

a lever pivotable about said pivot post between operative and inoperative positions for mating and unmating the connectors, the lever including an aperture embracing the pivot post, the aperture defining a closed loop around the pivot post and being larger than the post to allow for lost motion between the lever and the post, and the lever including a latch portion engageable with the mating connector for drawing the connectors into mated condition in response to rotating the lever about the pivot post from said inoperative position to said operative position; and a spring operatively connecting the lever and the pivot post to bias the lever in the mating direction of the mating connector when the lever is in its operative position to, thereby, bias the mating connector into a fully mated position.

2. The electrical connector of claim 1 wherein said spring is generally U-shaped with a distal end of one leg fixed to the lever and a distal end of an opposite leg fixed to the pivot post.

3. The electrical connector of claim 1 wherein said housing includes a cover having said pivot post thereon and on which said lever is mounted.

4. The electrical connector of claim 1, including a detent recess in the latch portion of the lever and into which a latch projection of the mating connector snaps to give an audible and tactile indication of the fully mated position of the mating connector.

5. The electrical connector of claim 1 wherein said latch portion of the lever is located at one side of the pivot post and said spring is located at an opposite side of the pivot post.

6. The electrical connector of claim 1 wherein said latch portion of the lever comprises a latch hook for engaging a latch projection on the mating connector.

7. The electrical connector of claim 6, including a detent recess at a base of the latch hook and into which the latch projection of the mating connector snaps to give an audible and tactile indication of the fully mated position of the mating connector.

8. The electrical connector of claim 1 wherein said lever is generally U-shaped and straddles the housing with a pair of lever arms on opposite sides of the housing pivotable about a pair of pivot posts at the opposite sides of the housing, and with at least one of said springs being operatively associated between one of the lever arms and one of the pivot posts.

9. The electrical connector of claim 8, including one of said springs operatively associated between each lever arm and its respective pivot post.

10. An electrical connector assembly, comprising:

a connector having a housing adapted for mating with an appropriate complementary mating connector, said housing including a cover and a lever pivot post fixed to and projecting from each of two opposite sides of the cover;

a generally U-shaped lever straddling the housing and includes a pair of lever arms pivotable about said pivot posts on opposite sides of the housing so that the lever pivots between operative and inoperative positions for mating and unmating the connectors, the lever arms including apertures embracing the pivot posts, the apertures being larger than the posts to allow for lost motion between the lever and the posts, and each lever arm including a latch portion on one side of the respective pivot post engageable with the mating connector for drawing the connectors into mated condition in response to rotating the lever about the pivot posts from said inoperative position to said operative position; and a spring operatively associated between each lever arm and the respective pivot post to bias the lever in the mating direction of the mating connector when the lever is in its operative position to, thereby, bias the mating connector into a fully mated position, the spring for each lever arm being located at an opposite side of the pivot post from the latch portion of the lever arm.

11. The electrical connector of claim 10 wherein each spring is generally U-shaped with a distal end of one leg of the spring fixed to the respective lever arm and a distal end of an opposite leg of the spring fixed to the respective pivot post.

12. The electrical connector of claim 10, including a detent recess in the latch portion of each lever arm and into which a latch projection of the mating connector snaps to give an audible and tactile indication of the fully mated position of the mating connector.

13. The electrical connector of claim 10 wherein said latch portions of the lever arms comprise latch hooks for engaging appropriate latch projections on the mating connector.

14. The electrical connector of claim 13, including a detent recess at a base of the latch hook for each lever arm and into which the respective latch projection of the mating connector snaps to give an audible and tactile indication of the fully mated position of the mating connector.

15. An electrical connector assembly, comprising:

a connector having a housing adapted for mating with an appropriate complementary mating connector and a pivot post fixed to and projecting from the housing;

a lever pivotable about said pivot post between operative and inoperative positions for mating and unmating the connectors, the lever including an aperture embracing the pivot post, the aperture being larger than the post to allow for lost motion between the lever and the post, and the lever including a latch portion engageable with the mating connector for drawing the connectors into mated condition in response to rotating the lever about the pivot post from said inoperative position to said operative position; and a spring operatively associated between the lever and the pivot post to bias the lever in the mating direction of the mating connector when the lever is in its operative position to, thereby, bias the mating connector into a fully mated position wherein said spring is generally U-shaped with a distal end of one leg fixed to the lever and a distal end of an opposite leg fixed to the pivot post.

* * * * *